US008638539B2

(12) United States Patent
Betancourt

(10) Patent No.: US 8,638,539 B2
(45) Date of Patent: Jan. 28, 2014

(54) METHOD AND APPARATUS FOR ISOLATING HIGH VOLTAGE POWER CONTROL ELEMENTS

(75) Inventor: Erick Betancourt, Carlsbad, CA (US)

(73) Assignee: The Watt Stopper, Inc., Carlsbad, CA (US)

( * ) Notice: Subject to any disclaimer, the term of this patent is extended or adjusted under 35 U.S.C. 154(b) by 0 days.

(21) Appl. No.: 13/559,198

(22) Filed: Jul. 26, 2012

(65) Prior Publication Data

US 2013/0027832 A1 Jan. 31, 2013

Related U.S. Application Data

(60) Provisional application No. 61/512,323, filed on Jul. 27, 2011.

(51) Int. Cl.
*H01H 47/00* (2006.01)

(52) U.S. Cl.
USPC ..... 361/190; 361/160; 361/166; 361/167

(58) Field of Classification Search
USPC ..... 361/190
See application file for complete search history.

(56) References Cited

U.S. PATENT DOCUMENTS

| | | | | |
|---|---|---|---|---|
| 3,567,939 | A * | 3/1971 | Schadler et al. | 378/112 |
| 4,360,740 | A | 11/1982 | Conard | |
| 4,598,330 | A * | 7/1986 | Woodworth | 361/13 |
| 5,206,540 | A | 4/1993 | de Sa e Silva et al. | |
| 5,536,980 | A | 7/1996 | Kawate et al. | |
| 8,384,237 | B2 * | 2/2013 | Nefcy et al. | 307/9.1 |
| 2005/0122641 | A1 | 6/2005 | Fullington et al. | |

* cited by examiner

*Primary Examiner* — Rexford Barnie
*Assistant Examiner* — Terrence Willoughby
(74) *Attorney, Agent, or Firm* — K. David Crockett, Esq.; Paul J. Backofen, Esq.; Crockett & Crockett, PC

(57) ABSTRACT

The devices and methods described below provide for a high voltage control circuits using commercial lower voltage, and lower cost, relays. A low voltage control system using commercial switching relays is used to control and switch an isolated low voltage power supply through an isolation layer. The isolated low voltage power supply is used to drive commercial switching relays that control the high voltage power applied to the high voltage load. Adding the isolated low voltage power supply controlled through an isolation layer enables the use of commercial low voltage components to switch high voltage power such as 347VAC without violating Underwriters Laboratories spacing or testing requirements.

12 Claims, 2 Drawing Sheets

METHOD AND APPARATUS FOR ISOLATING HIGH VOLTAGE POWER CONTROL ELEMENTS

RELATED APPLICATIONS

This application claims priority from U.S. Provisional Patent Application 61/512,323 filed Jul. 27, 2011.

FIELD OF THE INVENTIONS

The inventions described below relate the field of electrical controls and more specifically, controls for high voltage relay drive circuits for controlling electrical loads.

BACKGROUND OF THE INVENTIONS

High voltage relays require physical isolation for safe operation. Underwriters Laboratories has recently increased its spacing and testing requirements for 347VAC systems. Underwriters Laboratories requires that a certain physical spacing exist between high voltage and any part that could come into contact with a person e.g., an installer or user. Typically, Underwriters Laboratories considers lower voltage circuits, typically 42.5VDC or less and 30VAC or less, to be contactable by a person. Common commercial relays violate the high voltage spacing requirement because the distance from the low voltage coil contacts to the high voltage relay contacts is generally less than the required minimum spacing.

Special relays are available that are Underwriters Laboratories listed for 347VAC operation, but those relays are much larger to meet the spacing requirements, cost three to four times as much as a common commercial relay, and are often a latching-type relay that may not be desired.

In a relay control circuit a low voltage coil, e.g., 6-24V DC or AC, is driven from a low voltage control circuit to establish a current in the coil, thereby establishing a magnetic field that pulls a relay contact armature connected to one high voltage contact toward another open high voltage contact, thereby causing the relay contacts to close and establish a closed high voltage circuit. This allows a high voltage supply on one relay contact to be connected to a load connected to the other contact for the purpose of controlling power to the load. 24VDC is a very common operating voltage in lighting controls, so it is common to find the relay coil being driven from a 24V supply. Most commercial relays are Underwriters Laboratories listed or rated for common U.S. operating voltages, e.g., 120VAC or 277VAC, because the physical spacing between the low voltage coil and the high voltage relay contacts meets Underwriters Laboratories spacing requirements, but those spacings are not suitable for control of 347VAC.

SUMMARY

The devices and methods described below provide for a high voltage control circuits using commercial lower voltage, and lower cost, relays. A low voltage control system using commercial switching relays is used to control and switch an isolated low voltage power supply through an isolation layer. The isolated low voltage power supply is used to drive commercial switching relays that control the high voltage power applied to the high voltage load. Adding the isolated low voltage power supply controlled through an isolation layer enables the use of commercial low voltage components to switch high voltage power such as 347VAC without violating Underwriters Laboratories spacing or testing requirements.

In an isolated high voltage control circuit as described, for example 24VDC, conceptually all elements of the isolated control power circuit are exposed to high voltage from a Underwriters Laboratories testing perspective. Rather than use an exposed low voltage supply to power the relay coil of the isolated power circuit, an isolated 24VDC supply is used. In order to still allow control by low voltage control circuitry, optical isolators or other suitable isolation components are used to send the control signal from the exposed low voltage system across a suitable isolation barrier, e.g., optical isolation, to the isolated high voltage system to control the "hot" relay coil. Since the isolated relay coil and isolated relay contacts are both considered to be located on the high voltage side of the circuit, it is possible to use a common commercial relay in an isolated high voltage application. This saves considerable cost and allows smaller commercial relays to be used, thereby allowing products to be made smaller, e.g., suitable for mounting inside of a standard junction box as is required by certain municipality building codes.

DETAILED DESCRIPTION OF THE INVENTIONS

Figure 1:
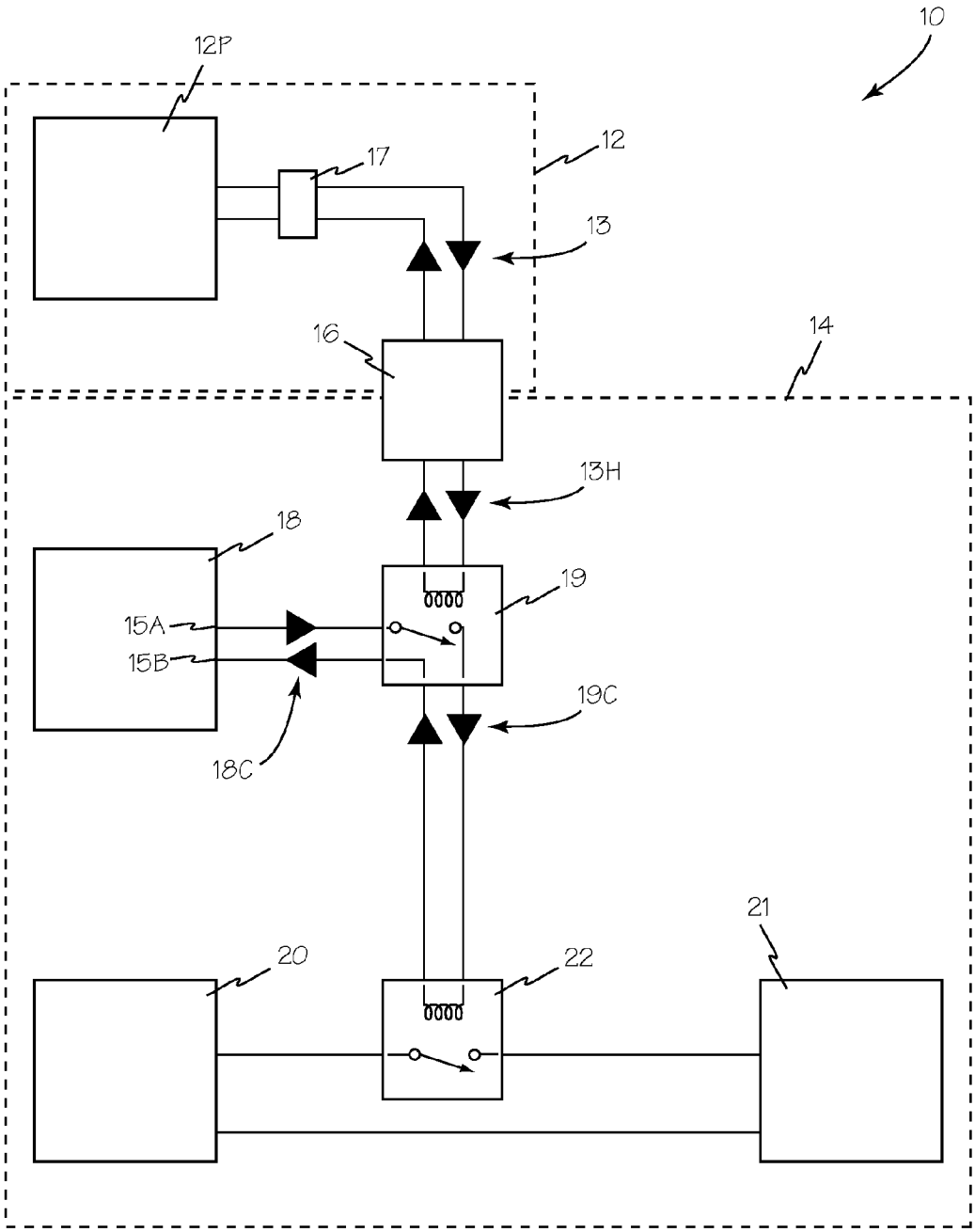
FIG. 1 is a block diagram of a multilayer isolated power control system.

In FIG. 1, multilayer power control system 10 includes first control system 12 which is a low voltage control system which controls high voltage power system 14 through isolation element 16. Low voltage control system 12 includes low voltage power supply 12P and control element 17 which produces low voltage control signals 13. Control element 17 may be any suitable user control such as a button, switch, relay or other electrical switching apparatus. Some or all of the elements of low voltage control system 12 may be enclosed in a conventional junction or switch box. Isolation element 16 may be any suitable control signal isolator such as an optical isolator. Isolation element 16 isolates and converts low voltage control signal 13 into one or more isolated control signals 13H which are applied to high voltage power system 14.

High voltage power system 14 is a control system that includes isolated low voltage power supply 18 and an isolated switching or control element such as relay 19. The isolated control element may be a single component such as relay 19, or it may be any suitable switching or control circuit such as a transistor switching circuit, a triac switching circuit, a silicon controlled switching circuit or an optical isolator switching circuit.

Figure 2:
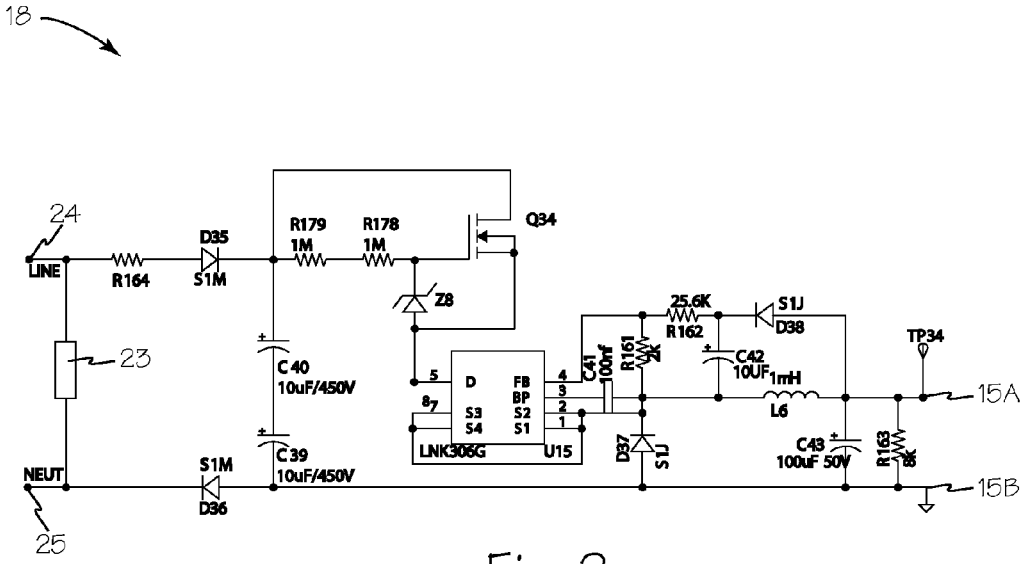
FIG. 2 is a schematic diagram of the isolated low voltage power supply of FIG. 1.

Power supply 18 is illustrated in FIG. 2 and applies control power 18C from terminals 15A and 15B, to relay 19 which is controlled by isolated control signals 13H to produce control signals 19C which are applied to a load switching element such as load relay 22 which switches high voltage power from high voltage supply 20 to load 21. Input protection component 23, such as a metal oxide varistor or a choke, may be placed in power supply 18 between the line and neutral connections, connections 24 and 25 respectively, and the inputs at R164 and D36. Resistors 178 and 179 in combination with zener diode Z8 drive MOSFET Q34 on when switcher U15 is on. MOSFET Q34 provides about 500 volts of additional voltage breakdown capacity to switcher U15.

Power and control components 18, 19 and 22 are commercial low voltage components which may be used because they are isolated in high voltage system 14. High voltage supply 20 and high voltage load 21 may be controlled by less expensive low voltage components 18, 19 and 22 if the low voltage components are isolated from users.

While the preferred embodiments of the devices and methods have been described in reference to the environment in which they were developed, they are merely illustrative of the principles of the inventions. The elements of the various embodiments may be incorporated into each of the other species to obtain the benefits of those elements in combination with such other species, and the various beneficial features may be employed in embodiments alone or in combination with each other. Other embodiments and configurations may be devised without departing from the spirit of the inventions and the scope of the appended claims.

I claim:

1. A high voltage power control system comprising:

a low voltage control system having a low voltage power supply producing a low voltage control signal which is controlled by a first control element producing one or more low voltage control signals which are applied to an isolation element to produce one or more high voltage control signals; and an isolated control system having a low voltage power supply producing an isolated low voltage control signal which is controlled by a second control element under control of the one or more high voltage control signals to produce one or more load control signals which are applied to a load control element which controls the application of high voltage energy from a high voltage power supply to one or more high voltage loads.

2. The high voltage power control system of claim 1 wherein the isolation element comprises:

an optical isolator.

3. The high voltage power control system of claim 1 wherein the first and second control elements are low voltage relays.

4. The high voltage power control system of claim 1 wherein the first control element is a switch and the second control element is a transistor switching circuit.

5. The high voltage power control system of claim 1 wherein the first control element is a switch and the second control element is a triac switching circuit.

6. The high voltage power control system of claim 1 wherein the first control element is a switch and the second control element is a silicon controlled rectifier switching circuit.

7. A high voltage power control system comprising:

a low voltage control system applying a first low voltage control signal to a first control element, the first control element producing one or more low voltage control signals which are applied to an isolation element to produce one or more high voltage control signals; and an isolated high voltage control system having an isolated low voltage power supply producing an isolated low voltage control signal which is controlled by a second control element under control of the one or more high voltage control signals to produce one or more load control signals which are applied to a load control element which controls the application of high voltage energy from a high voltage power supply to one or more high voltage loads.

8. The high voltage power control system of claim 7 wherein the isolation element comprises:

an optical isolator.

9. The high voltage power control system of claim 7 wherein the second control element is a low voltage relay.

10. The high voltage power control system of claim 7 wherein the second control element is a transistor switching circuit.

11. The high voltage power control system of claim 7 wherein the second control element is a triac switching circuit.

12. The high voltage power control system of claim 7 wherein the second control element is a silicon controlled rectifier switching circuit.

* * * * *